US006164302A

United States Patent [19]

Ko

[11] Patent Number: 6,164,302

[45] Date of Patent: Dec. 26, 2000

[54] COLLAPSING MECHANISM OF AUTOMATIC FOURFOLD COLLAPSIBLE UMBRELLA

[76] Inventor: Chin Sung Ko, No. 27-1, Lane 188, Sec. 3, Chin Mar Road, Changhua, Taiwan

[21] Appl. No.: 09/274,874

[22] Filed: Mar. 23, 1999

[51] Int. Cl.[7] ..... A45B 19/10

[52] U.S. Cl. ..... 135/25.3; 135/23; 135/31

[58] Field of Search ..... 135/22, 23, 25.1, 135/25.31, 25.32, 25.34, 29, 31, 32

[56] References Cited

U.S. PATENT DOCUMENTS

| | | | |
|---|---|---|---|
| 5,235,998 | 8/1993 | Liu | 135/31 X |
| 5,337,770 | 8/1994 | Wang | 135/31 X |
| 5,551,463 | 9/1996 | Wang | 135/25.3 |
| 5,617,889 | 4/1997 | Wu | 135/25.3 X |
| 5,626,161 | 5/1997 | Lin et al. | 135/37 X |
| 5,787,912 | 8/1998 | Wu | 135/29 |
| 6,016,822 | 1/2000 | Lin et al. | 135/24 |

*Primary Examiner*—Carl D. Friedman
*Assistant Examiner*—Winnie Yip
*Attorney, Agent, or Firm*—Rosenberg, Klein & Lee

[57] ABSTRACT

The present invention relates to a collapsing mechanism of automatic fourfold collapsible umbrellas, especially to an umbrella structure in which a restoring spring is disposed in a second parallelogrammatic frame set. The restoring spring can exert enough forces to quickly retract umbrella stretchers and ribs when an umbrella is collapsed. Thus the collapsing mechanism according to the invention can rapidly and smoothly pull down a fourfold collapsible umbrella.

1 Claim, 3 Drawing Sheets

COLLAPSING MECHANISM OF AUTOMATIC FOURFOLD COLLAPSIBLE UMBRELLA

BACKGROUND OF THE INVENTION

Most of conventional automatic foldable umbrellas are threefold or less as shown in FIG. 1. This is because the restoring spring (A) seated between a first main stretcher (B) and a first secondary stretcher (C) can not put a strong pulling force on the outermost rib of a fourfold collapsible umbrella. The position of the restoring spring makes the spring unable to exert sufficient forces to pull back umbrella stretchers when collapsing a fourfold collapsible umbrella. Thus the conventional umbrella structure is only suitable for a threefold or less collapsible umbrella. An automatic fourfold collapsible umbrella has not yet been found.

In view of the problem, the object of the present invention is to provide a collapsing mechanism used in an automatic fourfold collapsible umbrella that makes use of an innovative mechanism to enable the stretchers of an opened fourfold umbrella to be smoothly pulled back to a retracted position, accomplishing the work that a prior art mechanism can not do. Now the features and advantages of the present invention will be described in detail with reference to the accompanying drawings.

BRIEF DESCRIPTION OF THE ACCOMPANYING DRAWINGS

DETAILED DESCRIPTION OF THE PREFERRED EMBODIMENTS

Figure 1:
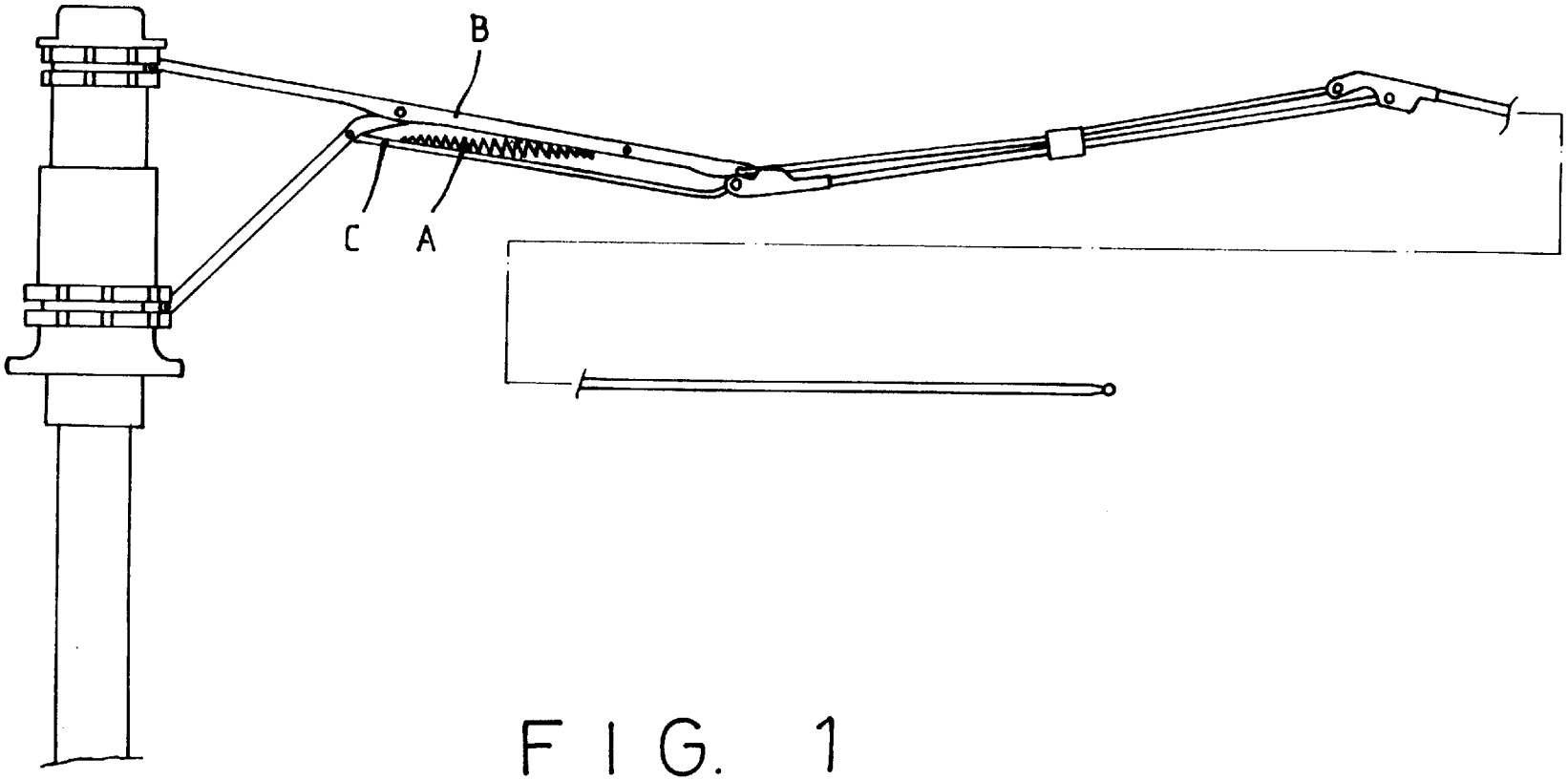
FIG. 1 (prior art)
FIG. 1 is a plan view showing a conventional collapsing mechanism used in an automatic threefold collapsible umbrella.
Figure 2:
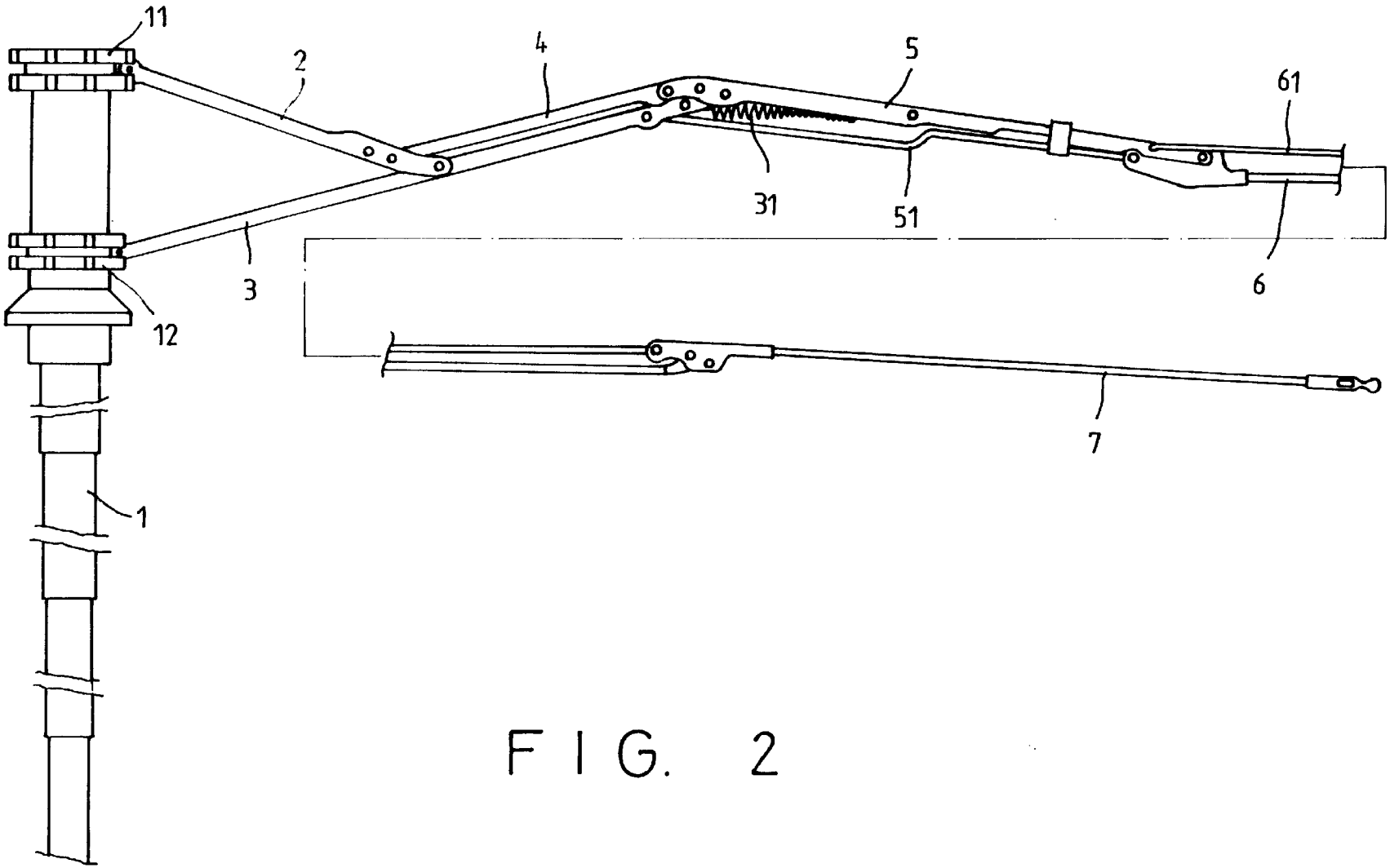
FIG. 2 is a plan view illustrating a collapsing mechanism used in an automatic fourfold collapsible umbrella according to the present invention.
Figure 3:
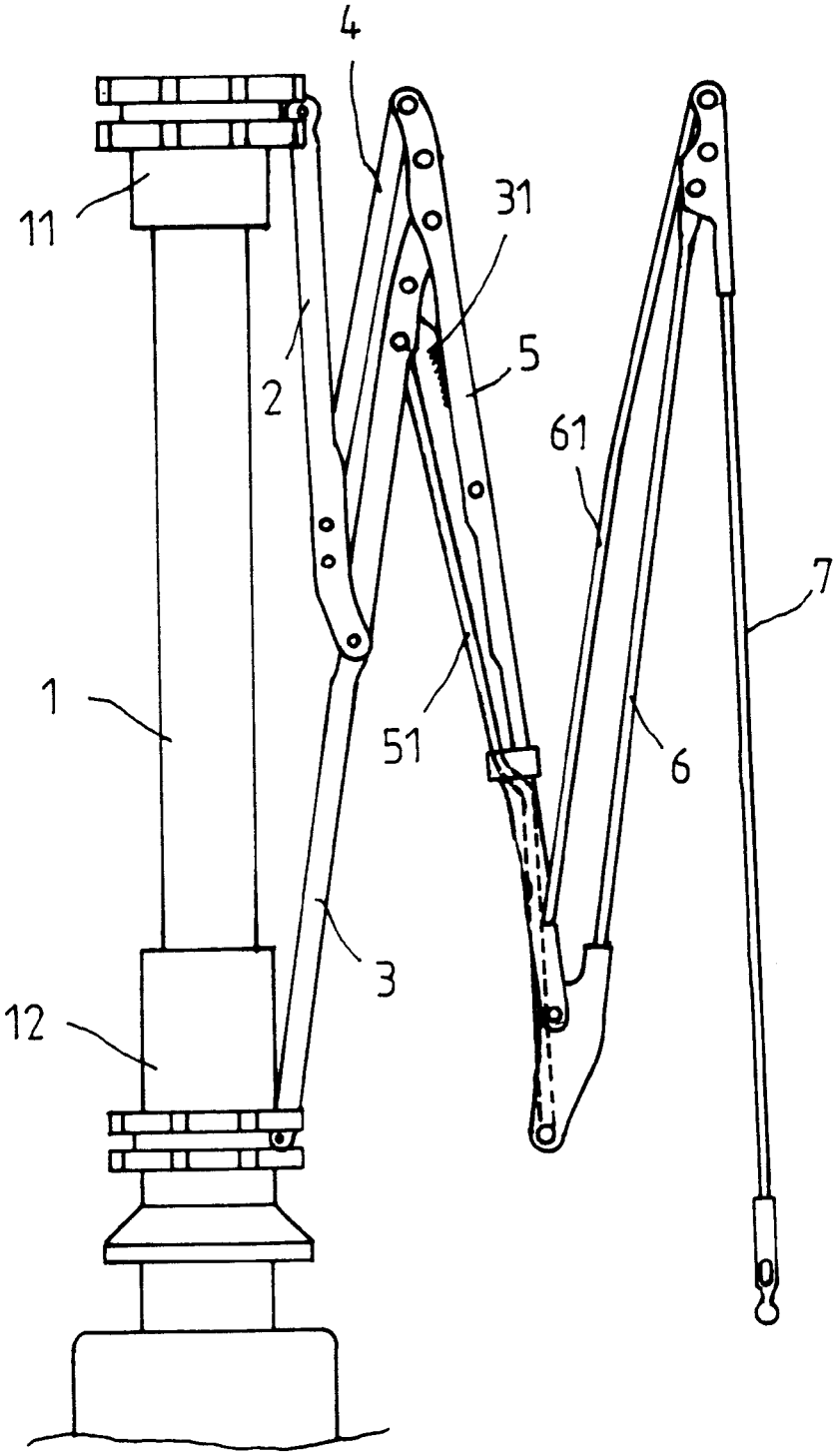
FIG. 3 shows the collapsing mechanism of FIG. 2 in a state that the fourfold collapsible umbrella is closed.

With reference to FIGS. 2 and 3, the present invention is featured by the improvements made on the umbrella structure that mainly comprises a fourfold umbrella structure consisting of an umbrella rod (1) with an upper nest (11) and a slide runner (12). A first main stretcher (2) outwardly extends from the upper nest (11), with the outer end pivotally connected to the middle segment of a secondary stretcher (3). The secondary stretcher (3) is pivoted at the inner end to the slide runner (12) and at the outer end to the front segment of a third main stretcher (5). A second main stretcher (4) is arranged in parallel to the secondary stretcher (3), with the inner end attached to the rear segment portion of the first main stretcher (2) adjacent the outer end of the second main stretcher, and the outer end of the secondary stretcher (3) is connected to the inner end of the third main stretcher (5).

A fourth main stretcher (6) is rotatably connected respectively at the inner end to the outer end of the third main stretcher (5) and at the outer end to the inner end of the rear umbrella rib (7). Furthermore, provided under the third main stretcher (5) and above the fourth main stretcher (6) respectively are flexible ribs (51) and (61). The above arrangement forms a fourfold collapsible umbrella stretcher structure in which a resilient spring (31) is disposed in the second parallelogrammatic umbrella frame set, with the inner end attached to the outer end of the secondary stretcher (3) and the outer end linked to the middle segment of the third main stretcher (5).

In the above arrangement, the point of applying pulling forces of the resilient spring on the umbrella stretchers is changed to a place that is closer to the outermost umbrella stretcher and so the collapsing mechanism of the invention can close an opened fourfold collapsible umbrella in an easy way. It is applicable to an automatic collapsing and opening umbrella structure, providing marvelous operational performance.

What is claimed is:

1. A collapsing mechanism used in automatic fourfold collapsible umbrellas comprising a fourfold collapsible umbrella stretcher structure that consists of:

an umbrella rod with an upper nest and a slide runner;

a secondary stretcher having an inner end pivotally coupled to said slide runner;

a first main stretcher outwardly extending from said upper nest, said first main stretcher having an outer end pivotally connected to a middle segment of said secondary stretcher;

a second main stretcher being arranged in parallel to said secondary stretcher, said second main stretcher having an inner end attached to a rear segment of said first main stretcher, said rear segment being adjacent said outer end first main stretcher;

a third main stretcher having an inner end pivotally coupled to an outer end of said second main stretcher, said third main stretcher having a front segment adjacent said inner end pivotally coupled to an outer end of said secondary stretcher;

a fourth main stretcher having an inner end rotatably connected to an outer end of said third main stretcher, said fourth main stretcher having an outer end pivotally coupled to a rear umbrella rib;

two flexible ribs being respectively provided under said third main stretcher and above said fourth main stretcher; and, a resilient spring having an inner end attached to the outer end of said secondary stretcher and an outer end linked to a middle segment of said third main stretcher above said flexible rib disposed under said third main stretcher.

* * * * *